United States Patent [19]

Vachhani et al.

[11] Patent Number: 4,669,799

[45] Date of Patent: Jun. 2, 1987

[54] CONNECTOR PANEL

[75] Inventors: Vasantrai A. Vachhani, Eden Prairie; Gilbert D. Bodimer, Burnsville, both of Minn.

[73] Assignee: Magnetic Controls Company, Minneapolis, Minn.

[21] Appl. No.: 740,805

[22] Filed: Jun. 3, 1985

Related U.S. Application Data

[63] Continuation of Ser. No. 492,504, May 6, 1983, abandoned.

[51] Int. Cl.[4] ..... H01R 9/24; H01R 11/20

[52] U.S. Cl. ..... 439/404; 439/719

[58] Field of Search ..... 339/97 R, 97 P, 198 R, 339/198 J, 210 R, 210 M, 98, 99 R, 206 R, 208

[56] References Cited

U.S. PATENT DOCUMENTS

| | | | |
|---|---|---|---|
| 3,112,147 | 11/1963 | Pferd et al. | 339/198 R |
| 3,417,368 | 12/1968 | Norden | 339/198 R |
| 3,530,426 | 9/1970 | Snyder, Jr. | 339/198 R |
| 3,777,223 | 12/1973 | Chandler et al. | 339/198 R |
| 3,820,055 | 6/1974 | Huffnagle et al. | 339/210 M |
| 4,006,957 | 2/1977 | Narozny | 339/103 M |
| 4,059,331 | 11/1977 | Sedlacek et al. | 339/198 R |
| 4,283,105 | 8/1981 | Ferrill et al. | 339/97 R |
| 4,340,268 | 7/1982 | Scalera | 339/97 P |

FOREIGN PATENT DOCUMENTS

| | | | |
|---|---|---|---|
| 2061030 | 5/1981 | United Kingdom | 339/97 P |

*Primary Examiner*—Gil Weidenfeld
*Assistant Examiner*—Gary F. Paumen
*Attorney, Agent, or Firm*—Dorsey & Whitney

[57] ABSTRACT

A connector panel for terminating and/or cross-connecting telecommunications or data transmission circuits including a base having a first set of connector receiving openings, a plurality of connectors adapted for connection with the base, a connector retaining member having a second set of connector receiving openings, and elements for securing the connector retaining member and the base together.

17 Claims, 15 Drawing Figures

CONNECTOR PANEL

This is a continuation of application Ser. No. 492,504, filed May 6, 1983, now abandoned.

BACKGROUND OF THE INVENTION

The present invention relates generally to a connector panel and more particularly to a connector panel having an array of connector elements of the type usable in the telecommunications or data transmission field for terminating or cross-connecting various selected conductors. The panel includes improved means for mounting the connectors in such array.

Connector panels having an array of connector elements are available in the prior art. Most of these comprise a relatively flat panel member having a plurality of openings provided with contact terminals. In these prior art structures, the portion of the connector element which faces the top side of the connector panel is provided with means for terminating a conductor wire from a telecommunication or data transmission line. In many cases, the portion of the contact terminal extending from the rearward side of the panel is also provided with means facilitating its connection with a second conductor element either by soldering, conventional wire wrap techniques or other connection means. The individual contact elements are retained within the connector panel in these prior art devices in a variety of ways. In U.S. Pat. No. 3,976,350 issued to Keglewitsch, the conductor elements are simply inserted into openings in the panel and retained therein by a shoulder portion. In U.S. Pat. No. 4,084,877 to Knickerbocker, the contact terminal is inserted into an opening in the connector panel and retained therein by a tab portion extending through an opening in the connector. In U.S. Pat. No. 3,932,017 to Dechelette, the connector elements are simply inserted into an opening in a connector panel and retained therein via a force fit. In U.S. Pat. No. 4,006,957 to Narozny, the conductor elements are inserted into openings within a base portion of the panel member and a second portion or keeper having a plurality of openings corresponding to the openings in the base is positioned over the connector elements. This second portion or keeper is retained by a further cover means.

SUMMARY OF THE INVENTION

The present invention differs from the prior art by providing a connector panel for use in the telecommunications and data transmission fields which embodies a plurality of split cylinder type connectors. More particularly, the present invention relates to a connector panel array embodying an improved and unique means for loading and retaining the individual connector elements within the panel. Although the device of the present invention has utility in a variety of applications, it has particular utility in the telecommunications area for use with a telephone connector block.

Specifically, the device of the present invention includes a first housing member comprising a base having a first set of connector receiving cavities or openings extending therethrough from the top to the bottom. Openings which are transversely aligned are connected with adjacent openings by a laterally extending groove or slot disposed in the top portion of the base and extending partially through the thickness of the base. A plurality of connector elements each having a split cylinder contact end are mounted within the panel. Each of these connector elements includes an intermediate mounting strip or support portion disposed near the lower end of the connector for insertion into the lateral slot or groove extending between the plurality of openings. In some cases, individual connector elements may be mounted or loaded within the groove whereas in other cases two or more individual connector elements may be joined together at their lower end by the support portion for mounting or loading into the groove. The end of the connector element opposite the split cylinder connector can also be provided with a connector end if desired.

The connector panel also includes a top or connector retaining member having a second set of connector cavities or openings extending from its top surface to its bottom surface with the openings being appropriately spaced for registration with the connector receiving openings in the base housing. This connector retaining member is positioned over the base housing and lowered so that the split cylinder connector ends extend through the openings in the top member. Means are associated with the top and base housing members for securely connecting these sections together in fixed relationship. In the preferred embodiment, this connecting means includes a plurality of tab portions positioned along an edge of the top section for engagement with corresponding openings in a side or shoulder portion of the base section.

The base section or housing also includes a fanning strip portion extending upwardly from each side edge for the purpose of guiding conductors to be terminated into appropriate position on the connector panel. These fanning strip portions extend upwardly past the top section and include a beveled base to provide improved lead-in and better alignment of the conductor wires with respect to such connector members.

Accordingly, it is an object of the present invention to provide a connector panel for use in the telecommunications or data transmission fields having an improved means for loading and retaining a plurality of connector elements within the panel.

Another object of the present invention is to provide an improved connector panel having an array of connector elements of the split cylinder type.

Another object of the present invention is to provide a slot portion with each of the openings to assist in supporting the connector elements.

Another object of the present invention is to provide an improved connector element usable with the connector panel of the present invention.

A further object of the present invention is to provide a connector panel having an array of split cylinder type connectors and a pair of fanning strips on opposite sides of such panel to facilitate better lead-in and alignment of conductor wires with the individual connector elements.

These and other objects of the present invention will become apparent with reference to the drawings, the description of the preferred embodiment and the appended claims.

DESCRIPTION OF THE PREFERRED EMBODIMENT

Figure 1:
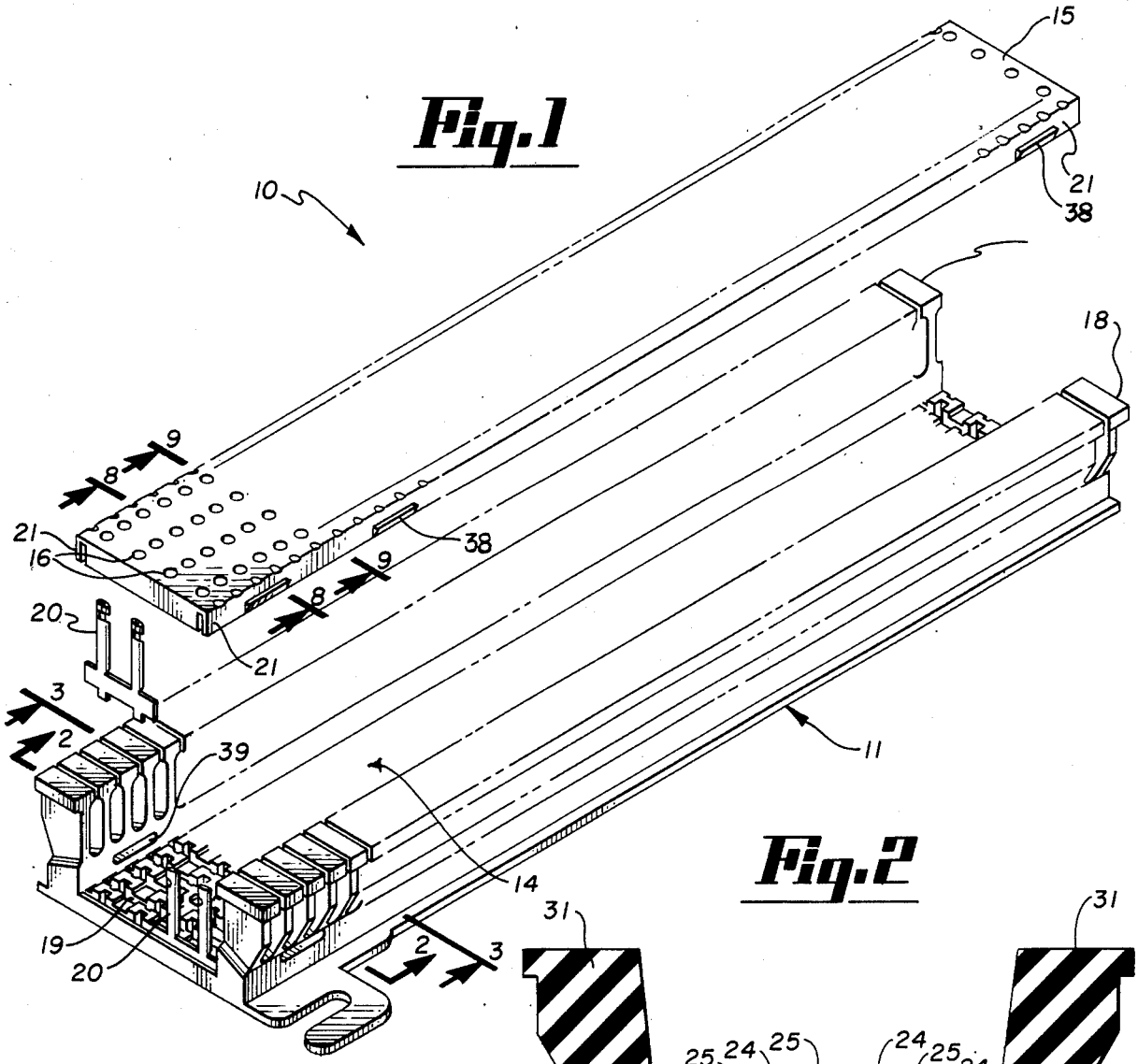
FIG. 1 is a pictorial view of the connector panel of the present invention showing the first or base portion of the panel with a plurality of connector elements loaded therein and the second or connector retaining portion ready for connection with the base portion.
Figure 2:
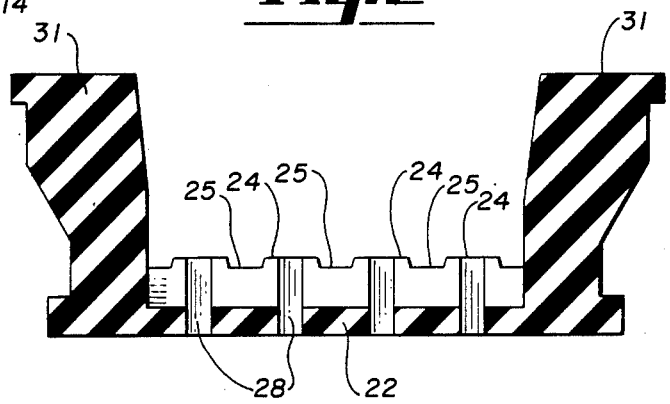
FIG. 2 is a view, partially in section, of the base portion as viewed along section line 2—2 of FIG. 1.

The connector panel of the present invention is illustrated in FIG. 1 and identified by general reference numeral 10. This connector panel 10 includes a first or base housing portion 11 and a top or connector receiving housing portion 15 adapted for connection with the base portion 11. A plurality of connector elements 20 are designed for placement within corresponding connector receiving openings 19 disposed within the base portion 11. After an entire array of connector elements 20 have been loaded into the base portion 11 as illustrated in FIG. 1, the top or connector retaining portion is positioned over the loaded connector elements 20 so that the openings 16 in the top portion 15 align with the connector elements 20. The top portion 15 is then lowered over the loaded connector elements 20 to a position where a connecting edge 21 disposed on each side of the connector receiving portion 15 snaps into and interlocks with corresponding connection means provided in the base portion 11. As further illustrated in FIG. 1, the base portion 11 includes a pair of fanning strips 18, 18 extending upwardly from each side edge of the base housing 11. These fanning strips 18 include a plurality of laterally spaced individual fanning elements 31 having openings therebetween to permit the feeding and guiding of individual conductor wires to the connector elements 20.

Figure 3:
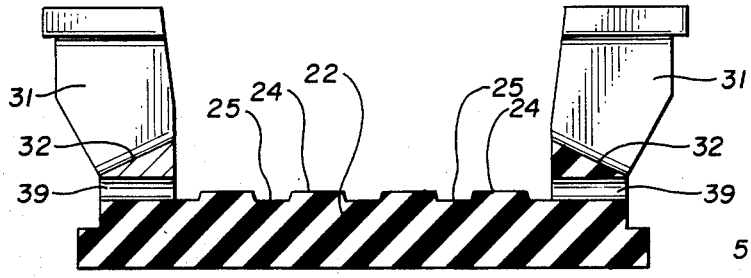
FIG. 3 is a view, partially in section, of the base portion as viewed along section line 3—3 of FIG. 1.
Figure 4:
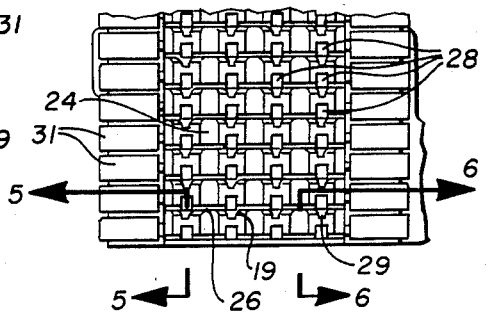
FIG. 4 is a top elevational view of a portion of the first or base housing of the connector panel of the present invention.
Figure 5:
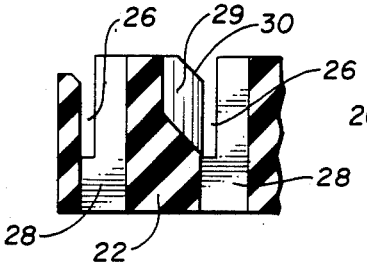
FIG. 5 is a view, partially in section, as viewed along the section line 5—5 of FIG. 4.
Figure 6:
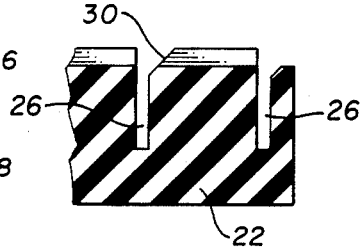
FIG. 6 is a view, partially in section, as viewed along the section line 6—6 of FIG. 4.
Figure 7:
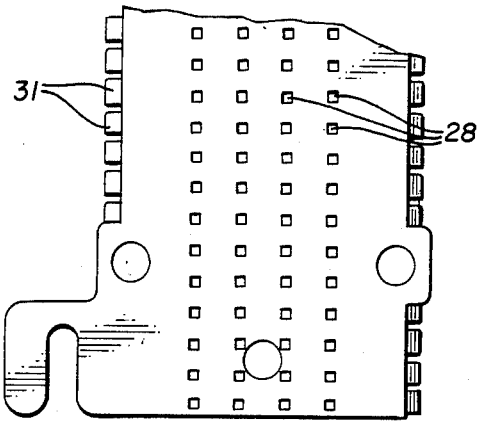
FIG. 7 is a bottom elevational view of a portion of the first or base housing of the connector panel of the present invention.

With more specific reference to FIGS. 2–7, the base portion includes an elongated, centrally disposed base housing 22. As illustrated best in FIGS. 2 and 3, this base housing 22 includes a plurality of elongated, raised rib portions extending substantially the entire length of the base housing 22. Disposed between these ridge portions 24 are a plurality of elongated recessed portions 25. The centrally positioned base housing 22 is also provided with a set of connector receiving openings 19 (FIG. 1). As illustrated best in FIGS. 4, 5 and 6, these connector receiving openings include several cavity portions. A first cavity portion includes the opening or hole 28 which extends entirely through the base housing 22 from its top surface to its bottom surface. In the preferred embodiment, this opening 28 extending through the base housing 22 is shown as having a generally square cross-section, although it can be circular or of various other shapes. A second cavity portion comprises the generally elongated slot or groove 26 extending transversely with respect to the longitudinal axis of the base housing 22. In the preferred embodiment, this transverse slot or groove 26 extends substantially across the entire width of the base housing 22 and intersects adjacent, laterally spaced openings 28. Thus, the slot 26 extends between and joins adjacent openings 28 in a direction transverse to the longitudinal axis of the housing portion 22. The slot 26 extends from the top surface of the base housing 22 downwardly toward the bottom of the housing 22 and terminates at a closed inner end. As also illustrated in FIGS. 5 and 6, the slot 26 includes a short, beveled lead-in edge 30 which extends from the top surface of the base housing 22 to the transverse slot 26. This beveled lead-in edge 30 permits the connector elements 20 (FIG. 1) to be more easily loaded into the base housing 22.

A third cavity portion comprises the portion 29 illustrated best in FIGS. 4 and 5. This portion 29 is an enlargement of the transverse slot 26 in the area adjacent the opening 28. This enlarged section 29 provides a lead-in for the connector elements 20 during the loading process. As illustrated generally in FIG. 1, and more specifically in FIGS. 2 and 3, the base portion 14 also includes a pair of upwardly extending fanning strips 18 integrally formed with the side edges of the base housing 22. Each of these fanning strips 18 is comprised of a plurality of individual fanning elements 31 spaced laterally from one another. This permits the conductors intended for connection with the connector elements 20 to be positioned between the fanning elements 31 so as to separate certain of the leads from one another and to group the same according to certain circuitry patterns. As best illustrated in FIG. 3, an improved feature of the fanning elements 31 is the provision of a beveled surface 32 formed at the base of the fanning strip. This beveled surface 32 permits a better lead-in to, and therefore alignment with, the various connector elements 20.

Figure 8:
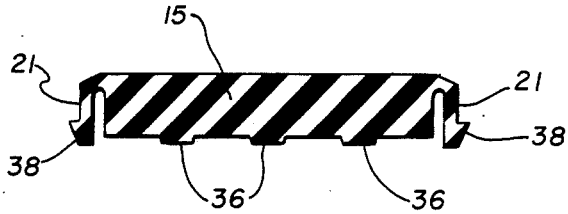
FIG. 8 is a view, partially in section, of the connector retaining portion of the connector panel as viewed along the section line 8—8 of FIG. 1.
Figure 10:
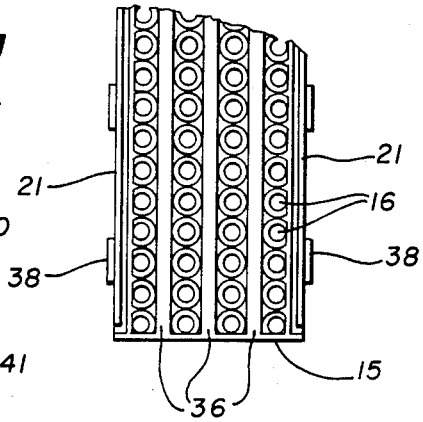
FIG. 10 is a bottom elevational view of the connector retaining portion of the conductor panel of the present invention.
Figure 9:
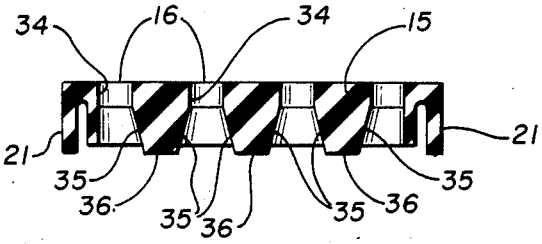
FIG. 9 is a view, partially in section, of the connector retaining portion of the connector panel as viewed along the section line 9—9 of FIG. 1.

As illustrated in FIGS. 8, 9 and 10, the top or connector retaining portion of the panel includes a centrally disposed top housing 15 which includes a set of connector receiving openings 16. These openings 16 are positioned for alignment with the openings 28 (FIG. 4) in the base housing 22. As shown best in FIG. 9, the openings 16 include an upper, generally cylindrical portion 34 and a generally frustro-conical lower portion 35 with the smaller end of the portion 35 in communication with the cylindrical portion 34 and the wider end of the portion 35 terminating at the bottom surface of the top housing 15. Disposed between adjacent openings 16 in a transverse direction are a plurality of elongated ribs 36 extending the length of the housing 15. These ribs 36 are positioned and sized so as to cooperate with and fit into the corresponding recessed portions 25 (FIGS. 2 and 3) in the base housing 22. Similarly, the portion at the bottom surface of the top housing 15 where the openings 16 are located are adapted to be aligned with the corresponding ribs 24 (FIGS. 2 and 3) of the housing 22. The cooperation between these corresponding ribs and grooves helps to maintain the top housing 15 in fixed position with respect to the bottom housing 22 when assembled. The portions 35 of the opening 16 are beveled in the manner illustrated so as to facilitate easy entry and lead-in of the connector elements 20 when the connector panel is assembled in the manner described in greater detail below. The dimensions of the upper portion 34 of the opening 16 approximate the external dimensions of the connector elements 20 to provide a relatively snug fit with minimal tolerance.

With reference to FIGS. 1, 8, 9 and 10, it can be seen that each side edge of the top housing portion 15 is provided with a connection member 21 integrally joined in its upper edge to a portion of the top housing 15. The lower edge of the connection member 21 is spaced from the adjacent side of the top housing 15 so as to permit some flexibility. A plurality of outwardly extending tab portions 38 are integrally formed at various points along the member 21 to facilitate connection of the top housing 15 with the base housing 22. The side portion of the base housing 22 is provided with a plurality of corresponding openings 39 (FIGS. 1 and 3) to receive the tabs 38 in interlocking relationship. Although the preferred embodiment shows the housing portion 15 as having the tab members 38 and the base housing 22 as having a plurality of correspondingly spaced openings 39, these elements could be reversed. In such a structure, the base housing 22 would include a plurality of tab elements and a side connection edge of the top housing 15 would embody a plurality of correspondingly spaced tab receiving openings.

Figure 13:
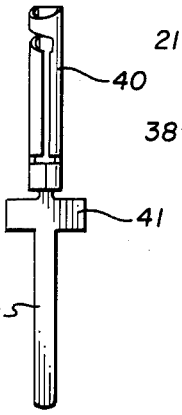
FIG. 13 is a front elevational view of a single connector element usable with the connector panel of the present invention.
Figure 11:
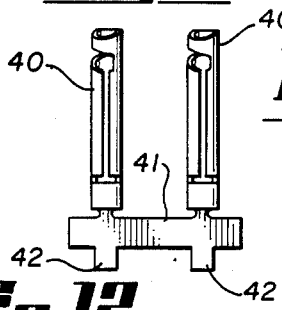
FIG. 11 is a front elevational view of a pair of connector elements usable with the connector panel of the present invention.
Figure 14:
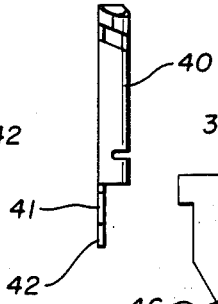
FIG. 14 is a side elevational view of the connector elements illustrated in FIG. 11.
Figure 12:
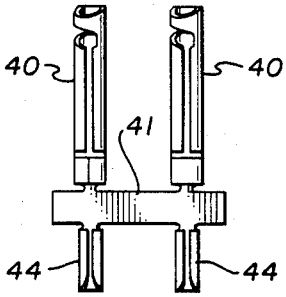
FIG. 12 is a front elevational view of a second embodiment of a pair of connector elements usable with the connector panel of the present invention.

The connector elements illustrated generally in FIG. 1 by the reference numeral 20 are illustrated more specifically in FIGS. 11, 12, 13 and 14. Although a variety of connector elements may be utilized, it is contemplated that each of the connector elements would have a generally cylindrical upper connector end 40 which is preferably of the split cylinder type. Each of the connector elements would also have a generally flat, vertically disposed intermediate portion or section joined at its top edge to the lower end of the cylindrical connector end 40. In the preferred embodiment, the intermediate section or support portion 41 lies in a plane parallel to the longitudinal axis of the connector element and is used to join two adjacent connector elements such as illustrated in FIGS. 11 and 12. it is also contemplated, however, that the intermediate section 41 could be associated with a single upper contact end 40 as illustrated in FIG. 13 or more than two connector elements. In the structures illustrated in FIGS. 11 and 12, the intermediate portion 41 electrically joins the contact portions 40, 40, thus providing a common electrical conductor between these two elements. In the preferred embodiment, the intermediate portion 41 includes a bottom or lower edge portion for supporting engagement with a bottom connector supporting surface of the slot 26 within which it is disposed. The preferred embodiment, as illustrated in FIGS. 11, 12 and 13, also shows the intermediate portion 41 as including a pair of extending portions extending laterally outwardly from the connector element 20 beyond the outer lateral surface of the upper contact end 40. Each of the connector elements also includes a lower portion integrally joined with the bottom edge of the intermediate portion 41. In FIG. 11 these lower portions include the short tab elements 42, 42 which simply extend into the opening 28 in the base housing 22 to help retain and align the connector elements with respect to the housing members 22 and 15. In FIG. 12, the lower portions comprise split cylinder type connector elements 44, 44. With this structure, the elements 44, 44 extend below the bottom surface of the base housing 22 for connection with conductor elements in a conventional manner. In FIG. 13, the lower portion comprises the elongated wire wrap end 45. This end is integrally joined with the intermediate portion 41 and extends below the bottom surface of the base housing 22 for connection with a conductor member via a conventional wire wrap process.

Figure 15:
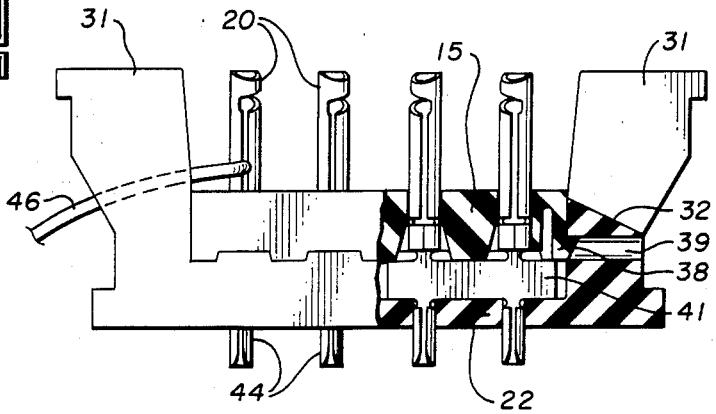
FIG. 15 is an end view, partially in section, of the fully assembled connector panel of the present invention.

To assemble the connector panel of the present invention, the individual connector elements 20 are first loaded into the base housing 22 by inserting the intermediate portions 41 (FIGS. 11, 12, 13 and 14) into the elongated transverse slots 26. The connector elements 20 are positioned so that the lower elements 42 (FIG. 11), 44 (FIG. 12) or 45 (FIG. 13) extend into or through the openings 28. The connector elements are propped up in this fashion with a bottom or lower support edge of the connector end 40 resting on the raised portions 24 of the base housing 22. These raised portions 24 provide a support surface for the lower support edge of the connector end 40. When the entire array of connectors has been loaded into the base housing 22 in this fashion, the top housing portion 15 is placed over the loaded connector elements so that they are in registration with the enlarged opening portions 35 on the bottom surface of the housing 15. When the housing 15 is properly aligned, it is moved downwardly over the upper portions 40 of the connector elements so that the tab portions 38 snap into the corresponding openings 39 in the side walls of the base 11. When this is done, the upper portions 40 of the connector elements 20 will extend above the top surface of the housing 15 to provide connection access to conductor elements in a conventional manner. An end view, partially in section of a loaded and assembled connector panel is illustrated in FIG. 15 showing a conductor wire 46 extending through adjacent fanning elements 31 and into one of the connectors 20.

Although the description of the preferred embodiment has been quite specific, it is contemplated that various changes and modifications could be made without deviating from the spirit of the present invention. Accordingly, it is intended that the scope of the present invention be dictated by the appended claims rather than by the description of the preferred embodiment.

We claim:

1. A connector panel comprising:

a base comprising a connector receiving portion having a top and a bottom surface and a set of first individual connector receiving openings extending therethrough from said top to said bottom surface;

a fanning strip integral with two opposite edges of the base;

a slot portion corresponding to each of said first connector receiving openings and extending partially through said base from said top surface toward said bottom surface, said slot portions being in communication with and extending laterally between adjacent first connector receiving openings so as to join adjacent first connector receiving openings in rows of at least two each and having a bottom connector supporting surface;

a plurality of connector elements each having a lower portion disposed within said first connector receiving openings, each of said connector elements have an upper contact end adapted for electrical connection with a conductor wire and an intermediate portion disposed within said corresponding slot portion, said contact end comprising a split cylinder connector having an elongated tubular body and a wire receiving slot extending generally parallel to the longitudinal axis of said tubular body and said intermediate portion including a flat portion lying in a plane generally parallel to the longitudinal axis of said connector element and having a pair of outwardly extending side portions and a bottom edge portion in supporting engagement with said connector supporting surface of said slot, said intermediate portion being integrally formed with said upper contact end and being disposed within said corresponding slot portion, said contact end including an upper wire receiving end and a lower support edge defined by a bottom edge of said contact end;

a connector retaining member having a top and a bottom surface and a set of second individual connector receiving openings extending through said retaining member from said top to said bottom surface and being spaced in substantial conformity and alignment with said set of first connector receiving openings, the bottom surface of said connector retaining member adapted for direct engagement with the top surface of said base whereby said contact ends of said connector elements extend through said set of second connector receiving openings and above the top surface of said connector retaining member for electrical connection with a conductor wire;

a contact end support surface associated with each of said first individual connector receiving openings for supporting engagement with said lower support edge of said connector element disposed within said first connector receiving opening to counteract the force resulting from insertion of said conductor wire into said wire receiving slot, said contact end support surface defined by a portion of the top surface of said base and being disposed adjacent to said associated first individual connector receiving opening; and means for securing said connector retaining member to said base.

2. The connector panel of claim 1 wherein said set of first connector receiving openings are arranged in a configuration comprising a plurality of aligned rows and columns.

3. The connector panel of claim 2 wherein said slot portions corresponding to each of said first connector receiving openings in each of said aligned rows are in communication with and extend between adjacent first connector receiving openings in said aligned rows.

4. The connector panel of claim 2 wherein said slot portions corresponding to said first connector openings in each of said aligned rows join with one another to form a single slot section.

5. The connector panel of claim 1 wherein said connector retaining member includes a flexible edge portion along each of its side edges and said base includes an upwardly extending shoulder portion along each of its side edges and wherein said means for securing said connector retaining member to said base includes a plurality of connection tabs disposed in each of said flexible edge portions and a plurality of cooperating openings disposed in each of said shoulder portions.

6. The connector panel of claim 5 wherein said flexible edge portion is spaced from the side edges of said connector retaining member and is integrally joined with said side edge along one of its side edges.

7. The connector panel of claim 1 wherein at least some of said connector elements are joined together in pairs by their respective intermediate portions.

8. The connector panel of claim 1 wherein the base of said fanning strips are beveled.

9. The connector panel of claim 1 wherein the top surface of said base and the bottom surface of said connector retaining member includes a plurality of longitudinally extending cooperating ribs and grooves to assist in aligning said base and connector receiving member and retaining the same with respect to one another.

10. The connector panel of claim 1 wherein the openings in said set of second openings include beveled portions joining the same with the bottom surface of said connector retaining member.

11. The connector panel of claim 1 wherein said connector element includes a lower end disposed on the side of said intermediate portion opposite to said contact end for insertion into at least a portion of said first connector receiving opening.

12. The connector panel of claim 1 having means for joining said base and connector retaining member as a result of movement of said connector retaining member toward said base in a direction generally perpendicular to said top surface of said connector receiving portion.

13. The connector panel of claim 1 wherein said slot portion lies in a plane generally perpendicular to said top and bottom surfaces of said base and has a width dimension smaller than the smallest cross-sectional width dimension of said first connector receiving openings.

14. A connector element adapted for use with a connector device which includes a base having a fanning strip integral with two opposite edges thereof and a set of first connector receiving openings extending therethrough and a slot portion extending partially through said base and disposed on at least one side of each of said openings, a connector retaining member having a set of second connector receiving openings adapted for alignment with said set of first connector receiving openings whereby the connector element extends through one of said second connector receiving openings, and means for securing said connector retaining member to said base, said connector element comprising:

a pair of first contact ends each adapted for electrical connection with a conductor wire and each comprising a split cylinder connector having an elongated tubular body, a wire receiving slot extending generally parallel to the longitudinal axis of said tubular body and a lower support edge for supporting engagement with a portion of said base; and an intermediate portion comprising a flat portion lying in a plane generally parallel to the longitudinal axis of the connector element, said intermediate portion integrally formed with said first contact ends to join said contact ends together and adapted for disposition within said slot portion.

15. The connector element of claim 14 including a second contact end disposed on the end of said connector element opposite said first contact end.

16. The connector element of claim 15 wherein said second contact end is a split cylinder connector.

17. The connector element of claim 14 wherein said flat portion of said intermediate portion includes extending portions extending laterally outwardly from the connector element beyond an extension of said first contact end.

* * * * *